US005791988A

United States Patent [19]

Nomi

[11] Patent Number: 5,791,988

[45] Date of Patent: Aug. 11, 1998

[54] COMPUTER GAMING DEVICE WITH PLAYING PIECES

[76] Inventor: Shigehiko Nomi, 12400 Marion La., Apt. #3301, Minnetonka, Minn. 55305

[21] Appl. No.: 681,185

[22] Filed: Jul. 22, 1996

[51] Int. Cl.[6] ..... A63F 3/00

[52] U.S. Cl. ..... 463/11; 463/25

[58] Field of Search ..... 463/10, 11, 12, 463/13, 14, 15, 25; 273/237

[56] References Cited

U.S. PATENT DOCUMENTS

| | | | |
|---|---|---|---|
| 4,019,745 | 4/1977 | Mustelier | 463/14 |
| 4,235,442 | 11/1980 | Nelson | 273/237 |
| 4,353,555 | 10/1982 | Flam | 273/148 |
| 4,534,562 | 8/1985 | Cuff et al. | 273/149 |
| 4,662,637 | 5/1987 | Pfeiffer | 273/149 |
| 5,039,102 | 8/1991 | Miller | 273/148 |
| 5,046,736 | 9/1991 | Bridgeman et al. | 463/13 |
| 5,121,921 | 6/1992 | Friedman et al. | 273/149 |
| 5,169,155 | 12/1992 | Soules et al. | 273/293 |
| 5,219,172 | 6/1993 | Laughlin et al. | 273/304 |
| 5,224,712 | 7/1993 | Laughlin et al. | 273/304 |
| 5,312,104 | 5/1994 | Miller | 273/148 |
| 5,362,053 | 11/1994 | Miller | 273/148 |
| 5,364,106 | 11/1994 | Laughlin et al. | 273/304 |
| 5,393,057 | 2/1995 | Marnell, II | 463/13 |
| 5,397,133 | 3/1995 | Penzias | 273/439 |
| 5,423,554 | 6/1995 | Davis | 273/437 |
| 5,531,440 | 7/1996 | Dabrowski et al. | 463/13 |

*Primary Examiner*—George Manuel
*Attorney, Agent, or Firm*—Crompton, Seager & Tufte, LLC

[57] ABSTRACT

A computer gaming device utilizing physical gaming pieces. The gaming device allows for play by a human player against one or more computer players. In one embodiment, the human player alone holds physical gaming pieces. In another embodiment, both computer players and human players hold physical gaming pieces. In one preferred embodiment, the gaming pieces include machine readable playing cards. The gaming device provides the familiar, physical experience of holding gaming pieces while playing against a computer opponent.

14 Claims, 3 Drawing Sheets

COMPUTER GAMING DEVICE WITH PLAYING PIECES

FIELD OF THE INVENTION

This invention is directed generally to gaming devices. Specifically, the invention is a gaming device providing play against a computer using playing pieces.

BACKGROUND OF THE INVENTION

Computer gaming devices enjoy increasing popularity. Home use computer games include video games and game programs running on general purpose computers. Home computer versions exist of card games and board games. Casino use games include video slot machines and video card games.

Players of computer games see only video displays of gaming pieces and feel only mechanical computer inputs. In a typical casino type computer game the player sees video displays of cards and pushes buttons to make game choices. Players do not see physical gaming pieces and do not touch physical gaming pieces.

Gaming and related gambling is a recreational activity. As a recreational activity, the subjective opinions of the players are important and determine whether computer gaming devices are played, and for how long. Current computer gaming devices have drawbacks. First, the player do not see the physical gaming pieces in a hand held by the computer. There is a lack of trust by gamblers when playing computer games. If a computer held card hand exists only in software, then there is a suspicion that the cards held might also change instantly in software, as the player would have a hard time telling that this had occurred. Second, the player does not see the physical shuffling of cards and subsequent placement into a deck on the table. This leads to suspicions of less than random shuffling as well as cards in the deck changing values to benefit the casino. Third, gaming pieces are not physically held by players. Gamblers often like to have the feel of cards or dice in their hands. Seeing the cards displayed on a video screens is not equivalent to many gamblers.

What has not thus far not been provided is a computer gaming device allowing use of physical gaming pieces when playing against a computer.

SUMMARY OF INVENTION

The present invention relates to computer gaming devices using physical gaming pieces. In one embodiment, the human player alone holds physical gaming pieces. In another embodiment, both computer players and human players hold physical gaming pieces. In yet another embodiment, both computer and human players utilize physical gaming pieces, but humans do not have custody of the physical pieces, being allowed only to view them. In preferred embodiments, the gaming pieces include machine readable playing cards and dice. Other embodiments utilize coins as gaming pieces. Suitable gaming pieces include any physical gaming piece used to play a game.

In a preferred home amusement, card playing version of the invention, a human player deals cards face down to positions representing computer players. The human player then submits the dealt cards face down to a card reader in a pre-ordained order, replacing the cards face down in that order. The bidding, betting, and playing commences as in a normal card game, with the computer player or players indicating information output such as betting amounts, bidding amounts, and which card to play through computer information outputs such as video display screens and dedicated display outputs. The human player or players inform the computer as to what human held cards have been played by either submitting them for reading or entering the values into the computer. Human players inform the computer of bidding, passing, or betting amounts using information inputs to the computer. These information inputs include standard computer input devices such aa key pads, mice, touch screens, and trackballs as well as dedicated switches.

In a preferred, casino embodiment of the invention, gaming pieces are read, output, and custody given to human players, who later give custody back to the device when the pieces are played, input to the device, and values read. In this casino embodiment of the invention, output gaming pieces are closely tracked both in value and other indicia to prevent cheating by human players. In a preferred casino embodiment, credit is input to and output from the machine by a human player, where such credit includes money, tokens, electronically encoded cards. In one embodiment, credit is output via displayed or print, for later payment by a human having knowledge of such display or print.

In another preferred, card playing, casino embodiment of the invention, much of the device and card display area are enclosed in a transparent cover. Cards are shuffled and dealt in plain view of the human player. Cards held by computer players are held with the card backs in plain view of the human player, yet unreadable by the human player. Cards held by human players are in custody of the machine, yet viewable by the human player. In a most preferred embodiment, the human player is able to select one of the hands after dealing. The transparent covered embodiment reduces fears of computerized changing of card values and rigged shuffling, but does not allow the feel of physical cards. In a variation of the above embodiment, the human player's hand is output from machine custody to the human player and input back for reading as the human player plays the cards. Cheating is made difficult by the fact that the computer knows which cards have been dealt to the human player, and therefore knows which cards are legally possible for the player to return.

In other embodiments of the invention, the gaming pieces include dice, which may remain in device custody or be transferred to the human player for physical possession and play.

The computer in a preferred embodiment has a historian portion that keeps score and keeps track of the credits input and output. In another embodiment, a "progressive" system tracks data including length of play since last payout, length of play by current player, and betting history. The progressive system factors the data into determining how much the device should bet against the human player. In other embodiments, a progressive system determines how much the payout should be.

In a preferred casino embodiment, the gaming device accepts player identity input information to historize playing activity for individual players. In a most preferred embodiment, this player identity input is accomplished with a "frequent player" machine readable card.

DETAILED DESCRIPTION OF THE PREFERRED EMBODIMENTS

Figure 1:
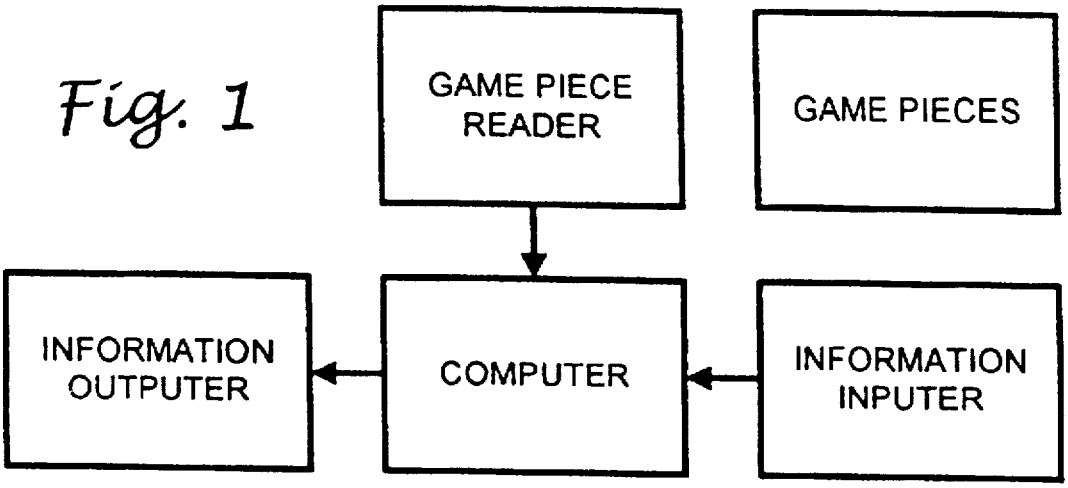
FIG. 1 is a block diagram illustrating major components of a home amusement embodiment of the invention.

FIG. 1 shows, in highly diagrammatic form, the major components of a minimal embodiment of the present invention.

Gaming Pieces

Gaming pieces used with this invention include dice, playing cards, chips, coins and dominos or similar gaming pieces. Other gaming pieces not specifically mentioned may also be used. The gaming pieces are both machine and human readable. One embodiment of the gaming piece is bar coded. Another embodiment has magnetic indicia. Yet another embodiment has an embedded microchip responsive to external electromagnetic signals. Other indicia not specifically recited herein may also be used. Still another embodiment includes a gaming piece which is machine readable using machine vision.

Computer

Use of a computer is required to practice this invention. Suitable computers include general and special purpose computers running game programs. Embodiments include programs run from various sources including software media, firmware, and networks. In one embodiment, the computer is comprised of a single board computer. In another embodiment, the computer is comprised of more than one single board computer.

Information Inputer

The information inputer is a component for inputing human player information input into the computer. Such information includes, but is not limited to, game selection, that is, which game to play, bidding, player identification, pass information, that is whether the player wishes to pass, call or raise, betting amounts, whether the computer dealer must pick up a card, and card play information, that is, which card has just been played. Information inputers include computer input devices such as mice, trackballs, key boards, keypads, discrete switches, and rotary switches. Use of voice input is used in one embodiment of this invention. Other devices accomplishing the same function are also within the scope of the invention.

Information Outputer

The information outputer outputs information from the computer to the human players. Such information includes confirmation of human entered information, computer bidding, computer passing, win/loose announcements, current scores, and entreaties to play the game. Various embodiments include computer screen outputs, discrete lights, LED outputs, LCD outputs, voice synthesis, recorded voices, and computer generated, human understandable outputs in general.

Gaming Piece Reader

The gaming piece reader reads the value of the gaming pieces. Various embodiments include played card readers, dealt card readers, and dice readers. In some embodiments, the gaming piece reader is capable of reading both face down cards and face up cards. In other embodiments, the gaming piece reader reads only face down cards, requiring face up cards to be submitted for reading face down.

A played card reader feeds the value of played cards, i.e. face up cards, to the computer and allows for inputing information to the computer as to which card has been played by which human player. In high trust embodiments such as that of FIG. 1, the played card reader may be the same device as the information inputer means. That is, the played cards information may be input to the computer by a human player using the information inputer, where the human player is trusted to enter correct information. In other embodiments, the cards are submitted to a gaming piece inputer in communication with the computer. In one embodiment, the played card reader is a machine vision device capable of reading the value of played cards.

A dealt card reader feeds the values of dealt cards, i.e. face down cards, to the computer, and allows for inputing information to the computer as to which card has been dealt to which human and which computerized player. A dealt card reader may be used in a high trust embodiment where a human player-dealer has dealt the cards and the computer has no initial knowledge of what cards have been dealt or what cards are in the hand of any computerized player. The dealt card reader must be capable of reading cards discretely, such as reading face down cards, to allow players to have cards read without showing the hand to other players. Use of specially marked cards for machine reading is specifically within the scope of the invention. Another embodiment uses machine vision to read cards submitted face down over the dealt card reader.

Method 1

The methods of play possible with the embodiment of FIG. 1 are as varied as games themselves. In one method, a human or computerized player selects the game to be played. Cards are dealt by a human player. All face up cards and cards dealt to the computerized players are submitted to the gaming piece reader along with an entry of information as to the source of the card, which is specific to each game. Any information offered by human players must be entered into the information inputer. This includes bidding, betting, naming trump, passing, requesting a player to pick up a card and another information given by a human player relevant to the game and rules.

As human players play cards, they are submitted to the played card reader, which, as previously mentioned, may be the information inputer in high trust environments. Computerized players play cards via output from the computer dictating which card to play from the hand dealt of a computerized player. As the cards in the hands of the computerized player are likely face down, the card-to-play indication must be consistent with face down cards. In one embodiment, the cards in a computerized player's hand are known to the computer by position number, left to right, and indicated by this position number for example "#4", as the card to be played. When cards in a computerized player's hand are read, they should be read in an understood order, for example left to right, to support the aforementioned position scheme. In another embodiment, cards are held in a carrier, with the information outputer including an indicator on the carrier specifying the card to be played. In one embodiment, this indicator is an LED near the card to be played. In yet another embodiment, each card in the computerized player's hand is held separately and specified separately using an LED.

Where the gaming piece reader includes a dice reader, dice games are possible. Dice shaken by human players can be reported to the information inputer in some embodiments and can be read by the gaming piece reader in other embodiments. Computerized players may have their dice shaken for them by human players and reported by human players in high trust environments. In other embodiments, the dice may be shaken on the gaming piece reader by mechanical shakers and read by gaming piece readers.

Figure 2:
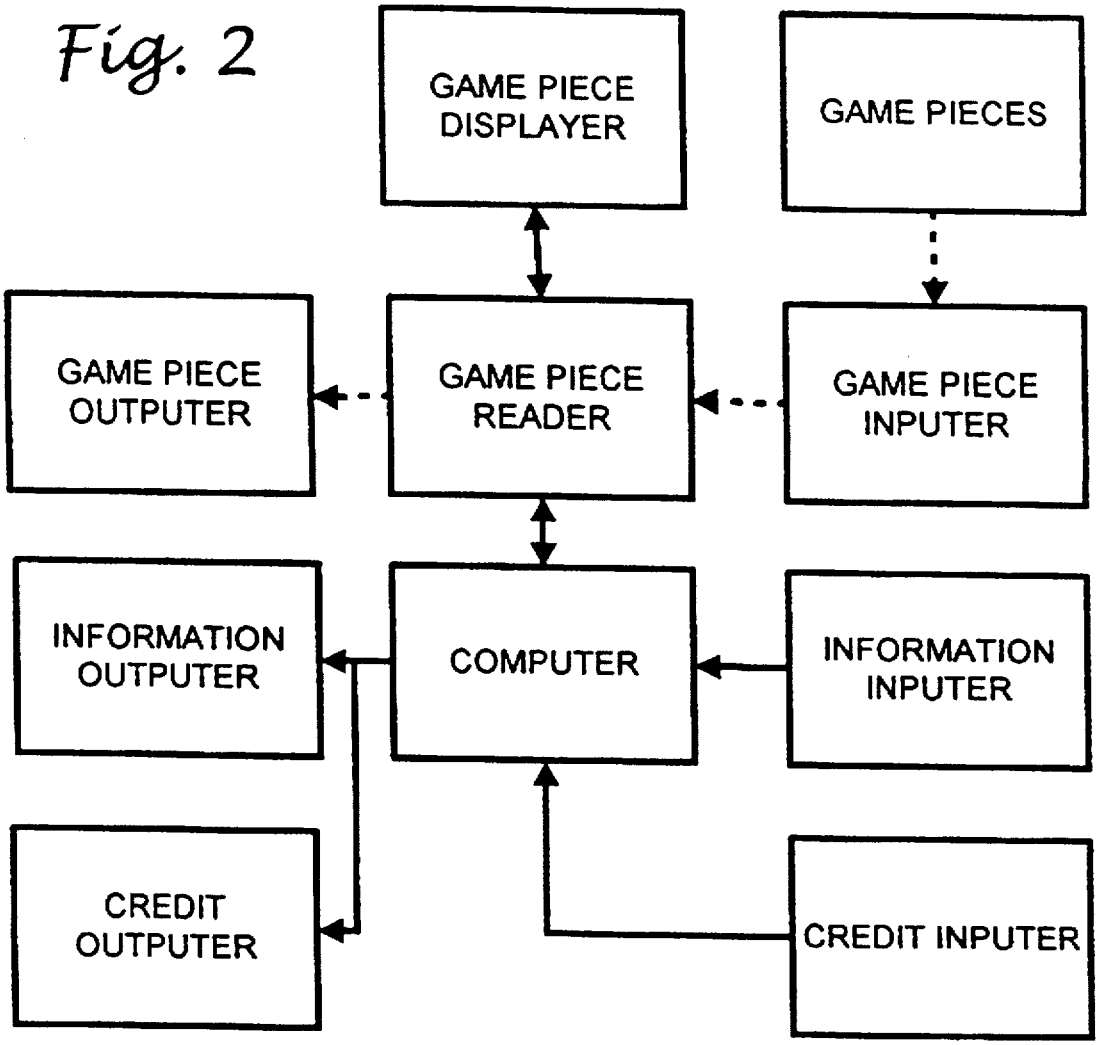
FIG. 2 is a block diagram illustrating a casino type embodiment of the invention.

FIG. 2 illustrates an embodiment similar to that of FIG. 1 further having a gaming piece inputer, gaming piece outputer, credit inputer, and credit outputer. The embodiment illustrated in FIG. 2 is more suited for low trust environments such as casinos.

Gaming Piece Inputer

FIG. 2 includes a gaming piece inputer. In one embodiment of a casino type device, gaming pieces played by human players have custody transferred to the gaming device for both reading and possession. That is, gaming pieces played by a human player must be turned over to the gaming device to be read, and once read, cannot be retrieved by the human player, except as authorized by the computer. One embodiment of such a gaming piece inputer is a chute for shaking dice into. While in a high trust environment players could be trusted not to arrange dice before depositing them on the gaming piece reader, this is not the case in a casino. In a preferred embodiment, dice are place on a shaker-reader surface, covered by a specific transparent cup, and shaking initiated in sight of the human player but out of immediate physical reach of the player during shaking and reading. Another embodiment would require transferring custody of a played card into a slot for reading.

Gaming Piece Outputer

FIG. 2 also includes a gaming piece outputer. A gaming piece outputer could be used to issue gaming pieces once paid for, deal cards, and play pieces for computerized players. A gaming piece outputer would often be informationally coupled with a gaming piece reader as the computer would need to know which gaming pieces had been issued and played. Information output could also be output with the gaming piece and would often dictate the intended destination or use, for example "for player #1". Such information output in some embodiments would be in the information outputer, and in other embodiments would be in the gaming piece outputer itself.

Credit Inputer

FIG. 2 includes an credit inputer. This component could be a coin slot, bill slot, token slot, magnetic card reader, and any other device capable of reading monetary or token type credit entered by a human player.

Credit Outputer

FIG. 2 also includes a credit outputer. This component can be a coin dispenser, bill dispenser, token dispenser, magnetic card writer, or any other device capable of transferring monetary or token type credit to a human player.

Gaming Piece Displayer

The gaming piece displayer in FIG. 2 is a component for displaying the value of gaming pieces without surrendering custody to the human players. In one embodiment, this includes a device for shaking dice and displaying the results to human players and the gaming piece reader as well. In a preferred embodiment, dice are placed on a shaker-reader surface, covered by a specific transparent cup, and shaking initiated in sight of the human player but out of immediate physical reach of the player during shaking and reading. In another embodiment, this includes a device for laying down played cards so as to be visible yet inaccessible to human players. In yet another embodiment, the hands of computerized players are viewable from the backs of the cards only until played.

Method 2

The methods of play possible with the embodiment of FIG. 2 are as varied as games themselves. The embodiment of FIG. 2 is more suited for casino type environments. In one method, a human or computerized player selects the game to be played. Cards are dealt by a computerized player through the gaming piece outputer, having been read by the gaming piece reader. Information output with the gaming piece would often dictate the intended destination or use, for example "for player #1". The computer remembers the intended destination and identification of every gaming piece issued through the gaming piece outputer. In a preferred embodiment of the invention, such remembered information is not shared by the computer with computerized players.

Any information offered by human players must be entered into the information inputer. This includes bidding, betting, naming trump, passing, requesting a player to pick up a card and another information given by a human player relevant to the game and rules.

As human players play cards, they are submitted to the gaming piece inputer. Computerized players in preferred embodiments play cards via the gaming piece outputer. In other embodiments, played cards from the computerized player are only shown on the information outputer, with the gaming pieces not being output themselves. In other embodiments, the computer played gaming pieces are displayed in the gaming piece displayer.

As more credits are required by the game, players must deposit them into the credit inputer. As credits are won by the players, they may be issued by the credit outputer. In a preferred embodiment of the invention, the credit inputer and outputer input and output coins. In another preferred embodiment, tokens are input and output.

Method 3

Figure 3:
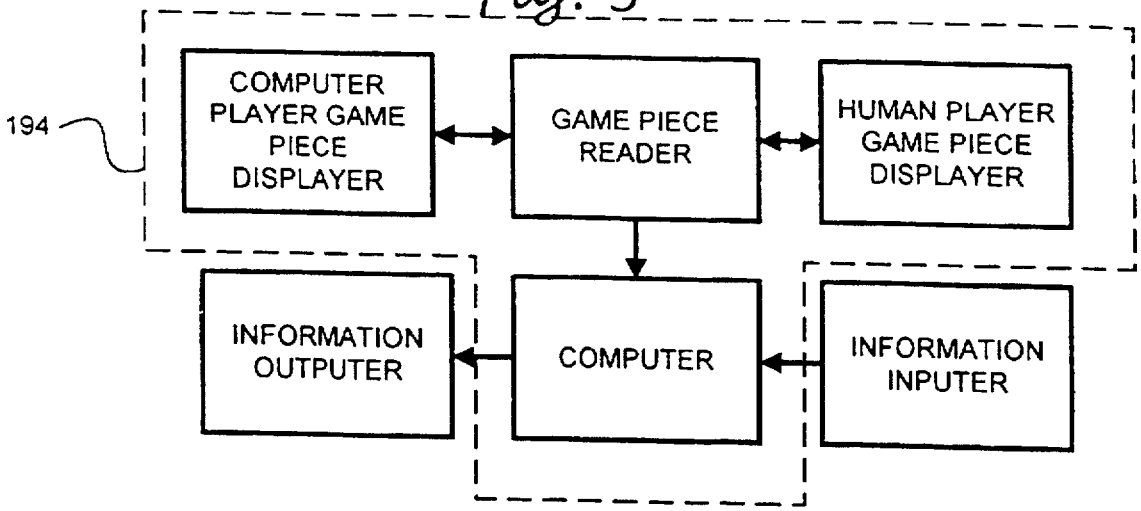
FIG. 3 is a block diagram illustrating an "under glass" casino type embodiment of the invention.

FIG. 3 illustrates an "under glass" embodiment of the invention, suitable for low trust environments such as casinos. In contrast to the embodiment diagrammed in FIG. 2, that of FIG. 3 has no game piece inputer or outputer that transfers gaming piece custody to or from the human player. This embodiment, suitable for playing cards, includes a card shuffler, card dealer, player hand holder, and at least one computer hand holder, all under a transparent cover 194, made of a material such as glass or a polymer. This device alleviates player fears of rigged shuffling and computer cheating via software. Transparent cover 194 is illustrated in a highly diagrammatic form in FIG. 3, enclosing the game piece reader, game piece displayers and computer.

The cards are shuffled and dealt in sight of the human player. Hands are dealt according the selected game rules. In a most preferred embodiment, the human player then selects a hand from among those dealt. The computer player's hand is then held in view of the human player, but with the card values unreadable. The human player's hand is held, under the transparent cover, with the card values viewable by the human player. The human player bids, bets, and selects cards to play via an information input device. The computer player plays cards by laying them down, face up. In this embodiment, human players are allowed to see, but not touch, the cards. In a variation on this embodiment, the human player's hand is output from machine custody to the human player and input back for reading as the human player plays the cards. Cheating is made difficult by the fact that the computer knows which cards have been dealt to the human player, and therefore knows which cards are legally possible for the player to return.

Figure 4:
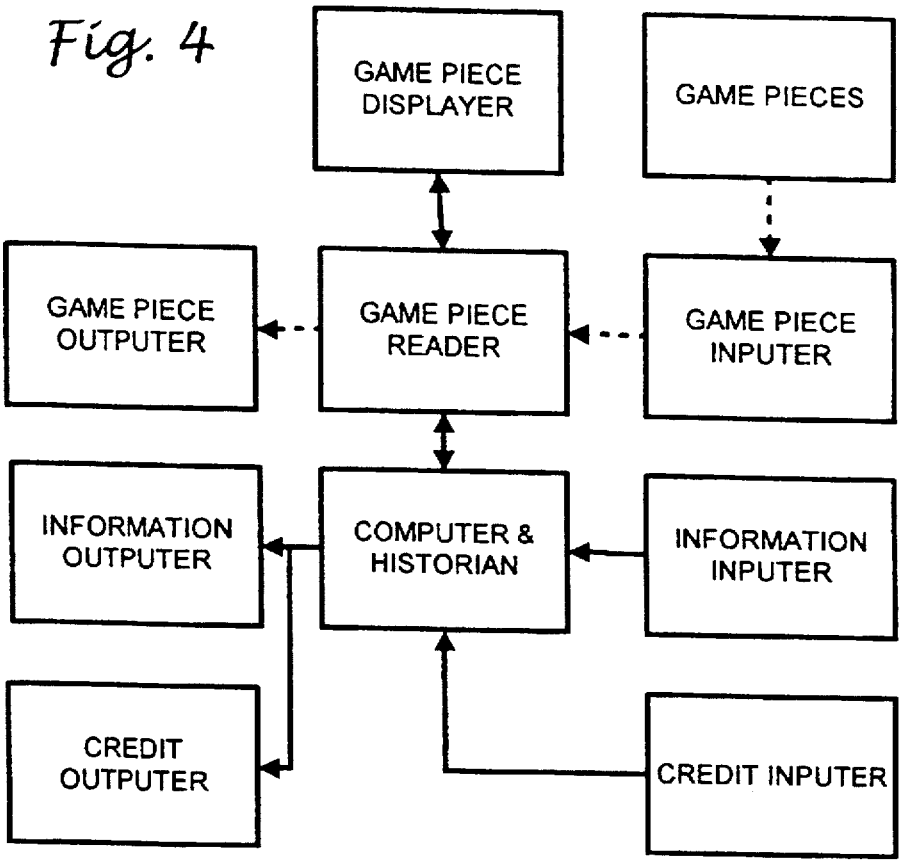
FIG. 4 is a block diagram illustrating a casino type embodiment of the invention including a historian.

FIG. 4 illustrates an embodiment of the present invention in accordance with the present invention similar to the embodiment of FIG. 2, further having a historian component. A historian is well suited to casino type play, where both security and player history information is desirable. The historian in a preferred embodiment is a program run in the computer. The historian in a preferred embodiment stores player identification information obtained from the information inputer, if entered. The historian may be informationally coupled to a progressive system of rules, which vary payout and/or betting amount on the history of the device being played and/or the player.

Figure 5:
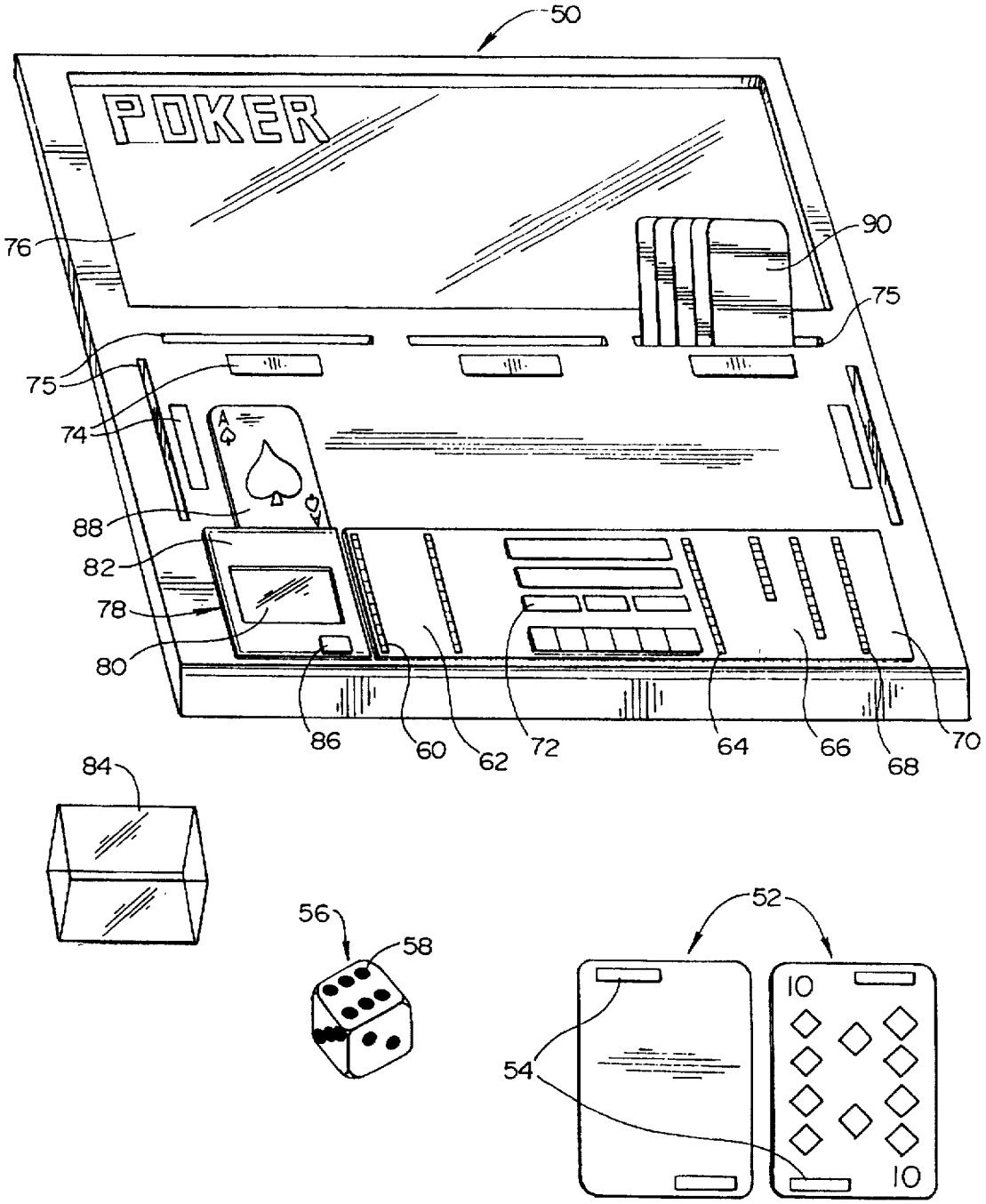
FIG. 5 is a perspective view of one embodiment of the invention.

FIG. 5 illustrates a home amusement embodiment of the present invention. Gaming device 50 as shown is suitable for playing with gaming pieces including cards 52 having machine readable identifiers 54 in addition to the normal markings, and a die 56 having machine readable identifiers 58.

The information inputer on the shown embodiment includes discrete switches 60 on a game selection panel 62, discrete switches 64 on a game environments setup panel 66, and discrete switches 68 on a bid/pass calculation panel 70.

The information outputer on the embodiment of FIG. 5 includes a digital score display 72, a digital message display 74, and a variable game play scales and instructions area 76.

The gaming piece reader of FIG. 5 includes scanner/recorder 78 which includes a dice reader-shaker 80 and a card reader 82. A hand of playing cards 90 held by a computer player in a card holder slot 75 is shown in FIG. 5.

The gaming piece inputer in FIG. 5 is shown as a combination of dice reader-shaker 80, dice roller button 86, and dice cover 84. Dice may be handled by a human player, but must be put onto dice reader-shaker 80, covered with dice cover 84, with shaking initiated via dice roller button 86, and dice read by dice reader-shaker 80. The gaming piece inputer of FIG. 5 includes card reader 82, shown reading playing card 88.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The inventions's scope is, of course, defined in the language in which the appended claims are expressed.

What is claimed is:

1. A computer gaming device for use by at least one human using machine readable physical gaming pieces comprising:

a computer;

information input means;

gaming piece reading means;

information output means;

a game program running a game on said computer, said game utilizing said machine readable physical gaming pieces; and at least one computerized player, where said computerized player is controlled by said game program and is a participant in said game program.

2. A computer gaming device as recited in claim 1 further comprising a gaming piece output means for transferring gaming piece custody to said human players.

3. A computer gaming device as recited in claim 2 further comprising a gaming piece input means for accepting gaming piece custody from said human players.

4. A computer gaming device as recited in claim 1 wherein said gaming pieces are playing cards and said game program is a card game.

5. A computer gaming device as recited in claim 4 further comprising a playing card output means for transferring playing card custody to said human players.

6. A computer gaming device as recited in claim 5 further comprising:

a credit input means for accepting credits from said human players; and a credit output means for disbursing credits to said human players.

7. A computer gaming device as recited in claim 6 further comprising:

a playing card input means for accepting custody of said playing cards deposited by said human players.

8. A computer gaming device as recited in claim 1 wherein said gaming pieces are dice.

9. A computer gaming device as recited in claim 8 further comprising computer controlled dice shaking means.

10. A computer gaming device as recited in claim 8 further comprising a dice output means for transferring dice custody to said human players.

11. A computer gaming device as recited in claim 10 further comprising a dice input means for accepting custody of dice from said human players.

12. A computer gaming device as recited in claim 8 further comprising:

a credit input means for accepting credits from said human players; and a credit output means for disbursing credits to said human players.

13. A computer gaming device as recited in claim 1 further comprising:

a means for preventing said human player from physically touching said gaming pieces while allowing said human player to view said gaming pieces; and a gaming piece play selection means informationally coupled to said information input means, wherein said gaming piece play selection means selects from among said viewable, untouchable gaming pieces for at least one piece to play.

14. A computer gaming piece device as recited in claim 13 wherein said touch prevention means is comprised of a transparent material selected from the group consisting of transparent glass and transparent polymer.

* * * * *